US005869179A

United States Patent [19]

Cahill et al.

[11] Patent Number: 5,869,179

[45] Date of Patent: Feb. 9, 1999

[54] IMAGING ELEMENT HAVING A CONDUCTIVE POLYMER LAYER

[75] Inventors: Douglas Allan Cahill, Belchertown; Everett Wyman Bennett, Easthampton, both of Mass.; Weitong Shi, Glastonbury, Conn.; Edward William Sporbert, Chicopee, Mass.; Alan Richard Taylor, Blandford, Mass.; Dene Harvey Taylor, Holyoke, Mass.

[73] Assignee: Rexam Graphics, Incorporated, South Hadley, Mass.

[21] Appl. No.: 646,913

[22] Filed: May 8, 1996

[51] Int. Cl.[6] ..... G03G 5/00; B44C 1/00

[52] U.S. Cl. ..... 428/354; 347/114; 347/153; 399/342; 428/41.4; 428/41.8

[58] Field of Search ..... 428/354, 41.4, 428/41.8; 156/240, 241, 230, 247; 347/114, 153; 399/342

[56] References Cited

U.S. PATENT DOCUMENTS

| | | | |
|---|---|---|---|
| 4,322,331 | 3/1982 | Shay | 524/815 |
| 4,420,541 | 12/1983 | Shay | 428/523 |
| 4,877,687 | 10/1989 | Azegami et al. | 428/520 |
| 4,981,729 | 1/1991 | Zaleski | 427/393.5 |
| 5,035,849 | 7/1991 | Uemura et al. | 264/255 |
| 5,130,391 | 7/1992 | Ahmed et al. | 526/288 |
| 5,400,126 | 3/1995 | Cahill et al. | 355/278 |
| 5,413,731 | 5/1995 | Adler et al. | 252/174.24 |
| 5,415,502 | 5/1995 | Cahill et al. | 355/278 |
| 5,483,321 | 1/1996 | Cahill et al. | 355/200 |
| 5,486,421 | 1/1996 | Kobayashi | 428/421 |
| 5,621,057 | 4/1997 | Herzig et al. | 526/248 |

FOREIGN PATENT DOCUMENTS

| | | |
|---|---|---|
| 04001214 | 1/1992 | Japan . |
| 06184470 | 7/1994 | Japan . |
| 06344514 | 12/1994 | Japan . |
| 07040498 | 1/1995 | Japan . |

OTHER PUBLICATIONS

Ebecryl® 350 Technical Data Sheet, Radcure, Louisville, Ky., May 1990.

Ebecryl® 1360 Technical Data Sheet, Radcure, Louisville, Ky., May 1990.

Rad 2500, Cureletter, Captan Associates, Inc., vol. 13(3), Mar. 1996, p. 7.

*Primary Examiner*—Jenna Davis

*Attorney, Agent, or Firm*—Ratner & Prestia

[57] ABSTRACT

An electrographic imaging element useful for forming colored images is described. The element contains an imaging layer structure and a support structure. The support structure contains an electrically conductive polymeric release layer formed by polymerizing a mixture containing a polymerizable, ethylenically unsaturated ammonium precursor; a polymerizable, ethylenically unsaturated, organosilicone precursor; a polymerizable precursor containing at least two polymerizable, ethylenically unsaturated functional groups; optionally, a polymerizable, ethylenically unsaturated acidic precursor containing at least one carboxylic acid group; and, optionally, a monofunctional precursor containing one polymerizable, ethylenically unsaturated functional group. The element is particularly useful for forming large size images, such as are required for banners, billboards, and other out-of-doors advertisements.

27 Claims, 2 Drawing Sheets

IMAGING ELEMENT HAVING A CONDUCTIVE POLYMER LAYER

FIELD OF THE INVENTION

This invention relates to elements for electrographic imaging. More particularly, this invention relates to elements for electrographic imaging comprising an electrically conductive polymeric release layer and to their use in forming color images.

BACKGROUND OF THE INVENTION

In electrographic imaging a latent image of electric charge is formed on a surface of a carrier. Toner particles that are attracted to the charge are applied to the surface of the carrier to render the latent image visible. The toned image is fixed, either by fusing the toner particles to the surface of the carrier, or by first transferring the toned image to a receptor and fusing, or otherwise permanently affixing, the particles to the receptor.

The latent image is produced by imagewise deposition of electrical charge onto the carrier surface. Typically, charged styli, arranged in linear arrays across the width of a moving dielectric surface, are used to create the latent image. Such processes are disclosed, for example, in Helmberger, U.S. Pat. No. 4,007,489; Doggett, U.S. Pat. No. 4,731,542; and St. John, U.S. Pat. No. 4,569,584.

After the latent image has been created on the surface of the carrier, toner is applied to produce a toned image. The toner is fixed to the surface of the carrier by heat fusing, or, if the toner is dispersed in a liquid, by drying and then, optionally, by heat fusing. When fixing is by drying only, the image is comparatively fragile and can be damaged by physical contact, abrasion, and the like.

Because color electrography needs only a carrier comprising a dielectric layer over a conductive support, it has, from its inception, been used for applications in which large size images are needed, such as for store graphics, posters, signs, banners, and other out-of-doors advertisements. In these applications the need for image protection is intense. Consequently, the color electrographic art has, from the outset, endeavored to protect the image.

One well-known way of protecting the image is to overlaminate the image with a permanent transparent protective film to form a laminate consisting of, in order, the carrier, the image, and the transparent protective film. In this method, the image is both fixed and protected between the original carrier and the transparent protective film in a single step.

In overlamination, the original carrier becomes an integral component of the final product. The carrier typically comprises a conductive base paper, which is unsuited for outdoor uses, even when protected by the overlaminated transparent protective film. Thus, overlamination is generally not suitable for preparing images for outdoor applications.

Another way of using the image, which avoids having the conductive base as part of the final product, is to laminate a receptor onto the toner that forms the image and then remove and discard the original carrier. In a second step, a permanent protective transparent film is laminated to the image and receptor, to form an element comprising the receptor, the toner image, and the permanent protective transparent film. The toner image is fixed and protected between the receptor and the permanent protective transparent film in two steps. This process is described in Chou, U.S. Pat. No. 5,262,259.

An alternative way that avoids having the conductive base as part of the final product is to laminate a receptor onto the surface of the dielectric layer which contains the toner that forms the image. Then the conductive base is removed and discarded, leaving behind the dielectric layer. This forms a product, comprising the receptor, the toner image, and the dielectric layer, in which the dielectric layer now serves as a protective layer. The image is fixed and protected between the dielectric layer and the receptor in a single step. Electrographic elements useful in this process are disclosed in Cahill, U.S. Pat. Nos. 5,414,502 and 5,483,321.

If the imaged and toned dielectric layer is to be transferred to provide a protective layer for the image, the dielectric layer must be able to release from the conductive base. To enhance release, a non-conductive release layer has been provided between the dielectric layer and the conductive base, increasing the cost and manufacturing complexity for the elements and lowering the density of the image. Therefore, to reduce manufacturing cost and improve image density, a need exists for electrographic imaging elements that do not comprise a separate release layer.

SUMMARY OF THE INVENTION

The invention is an imaging element comprising a support structure and an imaging layer structure wherein the support structure is removably adhered to the imaging layer structure and wherein the support structure comprises an electrically conductive polymeric release layer having tailored optical and surface release properties. The electrically conductive release layer comprises, in polymerized form:

(A) 1 to 80 weight parts of a polymerizable, ethylenically unsaturated ammonium precursor;

(B) 0.1 to 10 weight parts of a polymerizable, ethylenically unsaturated, organo-silicone precursor;

(C) 5 to 95 weight parts of a multifunctional polymerizable precursor containing at least two polymerizable, ethylenically unsaturated functional groups;

(D) 0 to 60 weight parts of a polymerizable, ethylenically unsaturated acidic precursor containing at least one carboxylic acid group; and (E) 0 to 90 weight parts of a monofunctional precursor containing one polymerizable, ethylenically unsaturated functional group.

The electrically conductive polymeric release layer has a thickness of about 1 to 20 microns, an electrical resistance between about $1\times10^5$ Ω/□ and $1\times10^8$ Ω/□, and a surface energy of between 20 and 40 dynes/cm$^2$.

In another embodiment, the invention is a method for forming an image using an imaging element of this invention.

DETAILED DESCRIPTION OF THE INVENTION

Imaging Element

Figure 1:
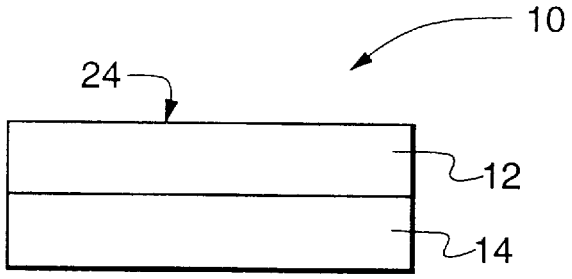
FIG. 1 is a schematic representation of an imaging element of this invention.

The invention is an imaging element suitable for use in electrographic imaging. The element comprises an electrically conductive polymeric layer, which can be formed into high-gloss or matte coatings.

The imaging element will now be described by reference to the accompanying drawings. Throughout the specification, similar reference characters refer to similar elements in all figures of the drawings.

Referring to FIG. 1, imaging element 10 comprises imaging layer structure 12 and support structure 14. Imaging layer structure 12 has imaging surface 24 on which the image is formed. Support structure 14 comprises the electrically conductive polymeric release layer. The detailed structure of imaging layer structure 12 and of support structure 14, which is dependent on the imaging method and the intended application of the image, is described below.

Electrographic Imaging Elements

Support Structure

Figure 2A:
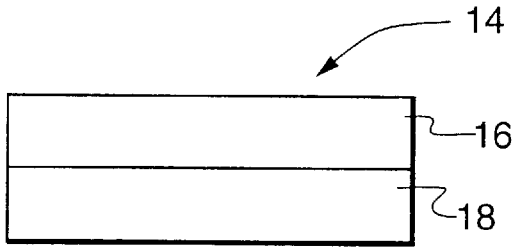
FIGS. 2*a* and 2*b* are schematic representations of the support layer structure of electrographic imaging elements of this invention.

In one embodiment, the invention is an element suitable for use as an electrographic imaging element. Referring to FIG. 2*a*, support structure 14 of electrographic imaging element 10 comprises electrically conductive polymeric release layer 16 and base 18.

Electrically Conductive Polymeric Release Layer

Electrically conductive polymeric release layer 16 has tailored optical, electrical, and surface release properties. The layer adheres tightly to base 18, has a high-gloss or a matte surface, has a surface resistivity of typically about $1\times10^5$ Ω/□, and affords easy release. By suitable choice of concentrations of three or more polymerizable components, surface conductivity can be varied over a wide range, i.e., an electrical resistance between about $1\times10^5$ Ω/□ and $1\times10^{12}$ Ω/□, without adversely affecting surface release characteristics. For electrographic imaging materials an electrical resistance between about $1\times10^5$ Ω/□ and $1\times10^7$ Ω/□ is preferred. Preferably the layer has a surface energy of between 20 and 40 dynes/cm$^2$.

Electrically conductive polymeric release layer 16 is prepared by radiation induced, free radical co-polymerization of three or more free-radical polymerizable materials. In this way, such polymerizable materials that would otherwise form individual polymers that are immiscible and incapable of affording defect-free coatings, can be conveniently converted via copolymerization into a single phase, thus achieving "forced" compatibility and simultaneously avoiding any problems due to component migration.

Electrically conductive polymeric release layer 16 is polymerized from a liquid mixture comprising three or more free-radical polymerizable materials containing one or more ethylenically unsaturated functional group(s). Based on the weight of the polymer to be formed, the liquid mixture comprises: 1 to 80 weight parts, preferably about 60 to 80 weight parts, of a polymerizable, ethylenically unsaturated, quaternary ammonium precursor; 0.1 to 10 weight parts, preferably about 0.2 to 2 weight parts, of a polymerizable, ethylenically unsaturated, organo-silicone precursor; and, 5 to 95 weight parts of a multifunctional polymerizable precursor containing at least two polymerizable, ethylenically unsaturated functional groups, wherein the multifunctional polymerizable precursor is a multifunctional monomeric material, an oligomeric material or a combination thereof. [Weight parts are equivalent to weight percent.] Preferably, the polymerizable, ethylenically unsaturated, organo-silicone precursor is a polyoxyalkylene modified organo-silicone having medium to high hydrophile/lipophile balance (HLB) and dispersing ability. A medium HBL means 8-5 and a high HBL is 13-18 as defined in Encyclopedia of Chemical Technology, Kirk-Othmer, 3rd ed., Vol. 8, p. 911.

Optionally, the liquid mixture may also contain up to 60 weight parts of a polymerizable, ethylenically unsaturated acidic precursor containing at least one carboxylic acid group to improve conductivity of the resulting polymer; and up to 50 weight parts of an other monofunctional precursor containing one polymerizable, ethylenically unsaturated functional group to further adjust the properties of the polymer, e.g., the glass transition temperature and flexibility. Preferably, the acidic precursor has an acid number between about 100 and about 900. When the polymerizable compounds are to be polymerized using ultraviolet light, the liquid mixture typically will contain up to 10 wt. % of a photoinitiator system.

"Precursor" means a polymerizable, ethylenically unsaturated, monomeric material, oligomeric material or other like component. Thus the precursors used to form electrically conductive polymeric release layer 16 are the free radical, addition polymerizable monomeric materials, oligomeric materials or other like components, in which each precursor contains one or more ethylenically unsaturated functional group(s). Each component is further described in the following paragraphs.

A) Ethylenically unsaturated ammonium precursor:

"Ammonium precursor" means an ethylenically unsaturated, quaternary ammonium salt compound which contains an ammonium cation and an inorganic or organic salt anion. Electrical conductivity of the polymer is obtained by use of the reactive ammonium precursors such as (3-(methacryloylamino)propyl)trimethylammonium chloride (MAPTAC), dimethylaminoethylmethacrylate dimethylsulfate quaternary (Ageflex® FM1Q80DMS), dimethylaminoethylacrylate methylchloride quaternary (Ageflex® FA1Q80MC), dimethylaminoethylmethacrylate methylchloride quaternary (Ageflex® FM1Q75MC), dimethylaminoethylacrylate dimethylsulfate quaternary (Ageflex® FA1Q80DMS), diethylaminoethylacrylate dimethylsulfate quaternary (Ageflex® FA2Q80DMS), dimethyldiallylammonium chloride (DMDAC), and vinylbenzyltrimethylammonium chloride, all of which are water soluble and, typically, are supplied with up to 50 wt% water. Consequently, such quaternary components are only miscible with a few very hydrophilic precursors unless a coupling solvent, such as those described below, is used.

"Quaternary salt precursors" typically have the following structures:

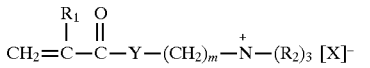

I

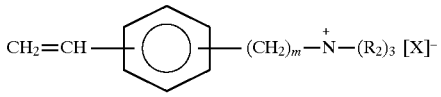

II

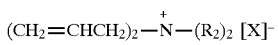

III in which $R_1$ is H, methyl, or ethyl; Y is —O— or —($NR_3$)—, wherein $R_3$ is H or a $C_1$–$C_4$ alkyl; m is an integer from 1 to 4, each $R_2$ individually is a $C_1$–$C_4$ alkyl group; and $[X]^-$ is an anion.

Preferably, the quaternary salt precursor contains a cation selected from the group consisting of (3-(methacryloylamino)-propyl)trimethylammonium, (2-

(methacryloyloxy)-ethyl)trimethylammonium, (2-(acryloyloxy)-ethyl)trimethylammonium, (2-(methacryloyloxy)-ethyl)-methyldiethylammonium, 4-vinylbenzyltrimethylammonium, dimethyldiallylammonium, and mixtures thereof. The anion may be any inorganic or organic salt anion conventionally used in such quaternary salts, such as chloride, methosulfate, nitrate, and the like. It was noted that the conductivity (or resistivity) of the coating is determined largely (but not wholly) by the molal concentration (number of moles per kilogram, all densities being close to unity) of quaternary salt present. For this reason, the most preferred quaternary structure is that with the lowest molecular weight, 2-acryloyloxyethyl trimethylammonium chloride, which also is expected to polymerize more easily than a methacrylate.

B) Ethylenically unsaturated, organo-silicone precursor:

The ethylenically unsaturated, organo-silicone precursor provides surface release characteristics to electrically conductive polymeric release layer 16. Surprisingly, only about 0.1 to 10.0 wt. parts of this precursor is required to provide adequate surface release characteristics to layer 16.

In contrast to the ethylenically unsaturated ammonium precursors described above, ethylenically unsaturated, organo-silicone compounds typically are immiscible with water. The term "immiscible" has its conventional meaning, i.e., a two-phase liquid mixture in which each liquid is insoluble or partially soluble in the other liquid and wherein each separate liquid phase is separated from the other by a common liquid-liquid interface, such as a suspension, dispersion, colloid, and the like.

Typically, the polymerizable, ethylenically unsaturated, organo-silicone is an acrylated silicone such as an acrylated-oxyalkylene-silicone wherein the alkylene is ethylene, propylene or a combination thereof, e.g., Ebecryl® 350 and Ebecryl® 1360 which have been discovered to have surfactant properties. From their cloud point behavior, water solubility, and infrared spectra, Ebecryl® 350 and Ebecryl® 1360 are believed to be acrylated polyoxyalkylene silicon copolymers wherein the solubilizing polyether units are derived from polyethylene glycol, polypropylene glycol, or a mixture of the two polyethers. The simpler acrylated polydimethylsiloxanes such as Goldschmidt RC-726, are commonly employed in the release coating industry but are not water soluble. However, such acrylated polydimethylsiloxanes can be employed, particularly, if used in conjunction with an acrylated surfactant type silicone polymer such as Ebecryl® 350 or Ebecryl® 1360.

"Acrylated-oxyalkylene-silicone" means an organo-silicone precursor having one or more acrylate or methacrylate groups bonded thereto, and one or more oxyalkylene groups incorporated therein or pendant thereto. The oxyalkylene group has the structure:

$$—(CH_2CHR)—O—$$

in which R is hydrogen or methyl.

Such acrylated-oxyalkylene-silicones may be used alone or in combination with an acrylated-silicone. Acrylated-oxyalkylene-silicones of this type include a polyacrylated polydimethylsiloxane-polyether copolymer having a viscosity of 200–300 centipoise at 25° C. (Ebecryl® 350); a hexaacrylate of a polydimethyl-siloxane-polyether copolymer having a viscosity of 1000–3000 centipoise at 25° C. (Ebecryl® 1360); and acrylate derivatives of hydroxy end-capped polydimethylsiloxane-polyether copolymers such as Silwet® L 7604, Coat-o-Sil® 3500 and Coat-o-Sil® 3501. Although the acrylated-silicone class of compounds (e.g., acrylated polydimethylsiloxane) are not water miscible nor compatible with quaternary salts, it was discovered that acrylated-oxyalkylene-silicones were acrylated surfactants of the siloxane-g-polyether type and, furthermore, were of high enough hydrophile/lipophile balance to have significant water solubility. Accordingly, when such acrylated silicone surfactants are incorporated into the quaternary containing coating mixtures, a solution can be obtained in some formulations (precursor rich formulations, especially those with a coupling solvent—see Example 7) and in others a usefully stable dispersion (formulations containing oligomeric acrylates to improve cure rate and physical properties—see Example 8), each of which can be readily cured to a dry film.

The efficacy of quite small amounts of such an acrylated silicone surfactant, 1–4 wt. %, in providing release properties toward aggressive pressure-sensitive adhesives is outstanding. It has been noted that the efficacy of the acrylated silicone release properties seems to be affected by the quaternary salt concentration being better with 28–30 wt. % quaternary than with 20–25 wt. % present; and that the acrylated silicone, Ebecryl® 350, provides good release at 1–4 wt. % all by itself and use of Ebecryl® 1360 provides no significant advantage aside from increasing the stability of dispersion type mixes. It was also noted that Ebecryl® 1360 acrylated siloxane (found to be a high HLB siloxane-g-polyether surfactant) caused significant and undesirable viscosity exaltation in some mixes compared to analogous formulations using Ebecryl® 350 (2400 cps. vs. 1400 cps.).

C) Multifunctional polymerizable precursor: The multifunctional polymerizable precursor functions as a free radical crosslinking agent to accelerate growth of the polymer during polymerization. The multifunctional polymerizable precursor may be a multifunctional monomeric material, an oligomeric material, or a combination thereof. The term "multifunctional" means two or more ethylenically unsaturated functional groups capable of free radical addition polymerization. "Monomeric materials" hereinafter are identified as "monomers". The term "oligomer" or "oligomeric" has its conventional meaning, a polymer whose properties change with the addition of one or a few repeating units. As such an oligomer functions as a pre-polymer having ethylenic groups capable of further polymerization. "Oligomeric materials" are identified as "oligomers".

Typical multifunctional monomers useful in forming electrically conductive polymeric release layer 16 include, for example, trimethylolpropane triacrylate, pentaerythritol triacrylate, pentaerythritol tetraacrylate, pentaerythritol tetramethacrylate, ethoxylated-trimethylolpropane triacrylate, glycerolpropoxy triacrylate, ethyleneglycol diacrylate, tripropyleneglycol diacrylate, and tetraethyleneglycol diacrylate. Particularly useful monomers are the ethoxylated precursors, such as ethoxylated-trimethylolpropane triacrylate (TMPEOTA).

Oligomers typically are used in the coating dispersions to achieve a cure rate rapid enough to meet polymer productivity goals. The criteria used to select useful oligomers are: viscosity, compatibility, glass transition temperature (Tg), degree of functionality, and coating glossiness. Illustrative of such oligomers are the commercial products tabulated along with their properties in the following tables. Typical oligomers useful in forming electrically conductive polymeric release layer 16 include, but are not intended to be limited thereby, acrylated urethanes, polyesters, and polyepoxides; and acrylics.

Useful acrylated urethanes include: Ebecryl® 230, an aliphatic urethane; Ebecryl® 244, an aliphatic urethane &

10% 1,6-hexanediol diacrylate; Ebecryl® 265, an aliphatic urethane & 25% tripropyleneglycol diacrylate; Ebecryl® 270, an aliphatic urethane; Ebecryl® 285, an aliphatic urethane & 25% tripropyleneglycol diacrylate; Ebecryl® 4830, an aliphatic urethane & 10% tetraethyleneglycol diacrylate; Ebecryl® 4833, an aliphatic urethane & 10% N-vinyl-2-pyrrolidone; Ebecryl® 4834, an aliphatic urethane & 10% N-vinyl-2-pyrrolidone; Ebecryl® 4881, an aliphatic urethane & 10% tetraethyleneglycol diacrylate; Ebecryl® 4883, an aliphatic urethane & 15% tripropyleneglycol diacrylate; Ebecryl® 8803-20R, an aliphatic urethane & 20% tripropyleneglycol diacrylate & 8% ethoxyethoxyethyl acrylate; and Ebecryl® 8803, an aliphatic urethane. Properties of these products are given in Table 1.

TABLE 1

| Product | Viscosity[1] | Mol. Wt.[2] | Groups[3] | Tg[4] |
|---|---|---|---|---|
| Ebecryl ® 230 | 30–50 @ 25° | — | 2 | 39 |
| Ebecryl ® 244 | 7.0–9.0 @ 60° | 2000 | 2 | — |
| Ebecryl ® 265 | 25–45 @ 25° | 2000 | 3 | 38 |
| Ebecryl ® 270 | 2.5–3.5 @ 60° | 1500 | 2 | — |
| Ebecryl ® 285 | 20–30 @ 25° | 1200 | 2 | 42 |
| Ebecryl ® 4830 | 2.5–4.5 @ 60° | 1200 | 2 | 42 |
| Ebecryl ® 4833 | 2.0–3.0 @ 60° | 1200 | 2 | 47 |
| Ebecryl ® 4834 | 3.0–4.0 @ 60° | 1600 | 2 | 32 |
| Ebecryl ® 4881 | 5.3–8.1 @ 60° | 2000 | 2 | 44 |
| Ebecryl ® 4883 | 2.8–4.2 @ 60° | 1600 | 2 | 47 |
| Ebecryl ® 8800-20R | 1.8–3.0 @ 65° | 1600 | 2.5 | 59 |
| Ebecryl ® 8803 | 25–35 @ 65° | 2300 | 2.4 | 52 |

[1]Viscosity is given in "10 poise" units & temperature is in "°C.".
[2]Molecular weight is based on neat undiluted oligomer.
[3]"Groups" is the number of ethylenic functional groups.
[4]"Tg" is glass transition temperature given in °C.

Useful polyester oligomers include: Ebecryl® 450, a fatty acid modified polyester; Ebecryl® 505, an unsaturated polyester & 40% tripropyleneglycol diacrylate; Ebecryl® 509, an acid modified unsaturated polyester & 30% 2-hydroxyethylmethacrylate; Ebecryl® 524, an acid modified polyester & 30% 1,6-hexanediol diacrylate; Ebecryl® 525, an acid modified polyester & 40% tripropyleneglycol diacrylate; Ebecryl® 584, a chlorinated polyester & 40% 1,6-hexanediol diacrylate; Ebecryl® 585, a chlorinated polyester & 40% tripropyleneglycol diacrylate; Ebecryl® 810, a tetrafunctional polyester acrylate; Ebecryl® 1810, a tetrafunctional polyester acrylate; and Photomer® 5018, an aliphatic tetrafunctional polyester acrylate. Properties of these products are given in Table 2.

TABLE 2

| Product | Viscosity[1] | Mol. Wt.[2] | Groups[3] | Tg[4] |
|---|---|---|---|---|
| Ebecryl ® 450 | 6–8 @ 25° | — | 6 | |
| Ebecryl ® 505 | 1.75–2.25 @ 60° | — | | 45 |
| Ebecryl ® 509 | 6–8 @ 25° | — | | |
| Ebecryl ® 524 | 55–65 @ 25° | 1000 | | |
| Ebecryl ® 525 | 35–45 @ 25° | 1000 | | |
| Ebecryl ® 584 | 1.5–2.5 @ 25° | — | | 44 |
| Ebecryl ® 585 | 4.2–5.2 @ 25° | — | | 29 |
| Ebecryl ® 810 | 0.45–0.65 @ 25° | 900 | 4 | 31 |
| Ebecryl ® 1810 | 0.45–0.65 @ 25° | 900 | 4 | 32 |
| Photomer ® 5018 | 0.7–1.4 @ 25° | 1000 | 4 | 0 |

[1]Viscosity is given in "10 poise" units & temperature is in "°C.".
[2]Molecular weight is based on neat undiluted oligomer.
[3]"Groups" is the number of ethylenic functional groups.
[4]"Tg" is glass transition temperature given in °C.

Useful polyepoxy oligomers include: Ebecryl® 605, a bisphenol A epoxy diacrylate & 25% tripropyleneglycol diacrylate; Ebecryl® 616, an epoxy dimethacrylate oligomer & 25% trimethylolpropane triacrylate; Ebecryl® 860, an epoxidized oil acrylate; Ebecryl® 1608, a bisphenol A epoxy acrylate & 20% propoxylated glycerol triacrylate; Ebecryl® 3200, a blend of aliphatic and aromatic acrylated epoxy resins; Ebecryl® 3201, an acrylated epoxy resin; Ebecryl® 3605, a partially acrylated bisphenol A epoxy resin; Ebecryl® 3700-20T, a bisphenol A epoxy acrylate & 20% trimethylolpropane triacrylate; Ebecryl® 3701-20T, a modified bisphenol A epoxy acrylate oligomer & 20% trimethylolpropane triacrylate; and Ebecryl® 3700, a bisphenol A epoxy diacrylate. Properties of these products are given in Table 3.

TABLE 3

| Product | Viscosity[1] | Mol. Wt.[2] | Groups[3] | Tg[4] |
|---|---|---|---|---|
| Ebecryl ® 605 | 6.5–8.5 × $10^3$ @ 25° | 525 | 2 | 65 |
| Ebecryl ® 616 | 20–30 @ 25° | 555 | 2 | 82 |
| Ebecryl ® 860 | 19–31 @ 25° | 1200 | 3 | 13 |
| Ebecryl ® 1608 | 0.9–1.1 @ 60° | 525 | 2 | 67 |
| Ebecryl ® 3200 | 1.5–3.0 @ 25° | 435 | 1.6 | 48 |
| Ebecryl ® 3201 | 2.5–5.0 @ 25° | 426 | 1.9 | 8 |
| Ebecryl ® 3605 | 0.5–0.8 @ 65° | 450 | 1 | 43 |
| Ebecryl ® 3700-20T | .43–.63 @ 65° | 524 | 2 | 75 |
| Ebecryl ® 3701-20T | .85–1.25 @ 65° | 840 | 2 | 62 |
| Ebecryl ® 3700 | 1.8–2.8 @ 65° | 524 | 2 | 65 |

[1]Viscosity is given in "10 poise" units & temperature is in "°C.".
[2]Molecular weight is based on neat undiluted oligomer.
[3]"Groups" is the number of ethylenic functional groups.
[4]"Tg" is glass transition temperature given in °C.

Useful acrylic oligomers include: Ebecryl® 745, an acrylic oligomer & 23% 1,6-hexanediol diacrylate & 23% tripropylene-glycol diacrylate; Ebecryl® 754, an acrylic oligomer & 30% 1,6-hexanediol diacrylate; and Ebecryl® 1755, an acrylic oligomer & 35% tripropyleneglycol diacrylate. Properties of these materials are given in Table 4.

TABLE 4

| Product | Viscosity[1] | Mol. Wt.[2] | Groups[3] | Tg[4] |
|---|---|---|---|---|
| Ebecryl ® 745 | 25–35 @ 25° | | | 30 |
| Ebecryl ® 754 | 70–60 @ 25° | | | 22 |
| Ebecryl ® 1755 | 70–80 @ 25° | | | 15 |
| Ebecryl ® 860 | 19–31 @ 25° | 1200 | 3 | 13 |

[1]Viscosity is given in "10 poise" units & temperature is in "°C.".
[2]Molecular weight is based on neat undiluted oligomer.
[3]"Groups" is the number of ethylenic functional groups.
[4]"Tg" is glass transition temperature given in °C.

Review of general properties and characteristics of a wide range of oligomeric materials above, suggests that epoxy oligomers would be useful because of their rapid cure rates and ability to provide high gloss. However, since the majority of epoxy oligomers have rather high viscosity at room temperature (e.g., 10,000–150,000 cps.) and Tg about 55°–67° C., for purposes of coatability it is considered necessary to include a low viscosity diluent with a low Tg to insure adequate flexibility. Thus solutions of oligomer in 20 to 40 wt. % di- or trifunctional diluent are useful. In a less complicated formulation, a single oligomer may be chosen such as a tetrafunctional aliphatic polyester with Tg of 0° C. and viscosity at 25° C. of 400–700 cps (Photomer® 5018).

D) Ethylenically unsaturated acidic precursor: The acidic precursor functions to further enhance the electrical conductivity of the polymeric material. Typical acid precursors that are useful in forming electrically conductive polymeric release layer 16, but are not intended to be limited thereby, acrylic acid, itaconic acid, β-carboxyethylacrylate, 2-(acryloyloxy)ethyl-o-phthalate, 2-(acryloyloxy)

ethylmaleate, 2-(acryloyloxy)ethyl-succinate, 2-(methacryloyloxy)ethylsuccinate, 2-(methacryloyloxy) ethyl-maleate, and 2-(acryloyloxy)propylmaleate; and carboxylated additives having acid nos. of 100 to 900, such as Ebecryl® 169 and Ebecryl® 170.

The acidic maleate and succinate acrylic precursors have the structure:

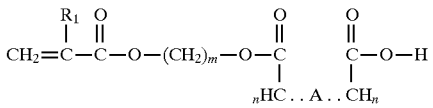

IV wherein $R_1$ is H, methyl, or ethyl; m is an integer from 1 to 4; ..A.. is a carbon-carbon double bond or single bond, wherein when ..A.. is a double bond n is 1 and when ..A.. is a single bond n is 2.

These materials are particularly useful precursors in the preparation of the polymeric materials. Preferred acidic precursors are the low molecular weight acidic acrylic precursors, β-carboxyethylacrylate and 2-(acryloyloxy)-ethylmaleate. When an acidic precursor is used in the preparation of the polymeric material, about 6 to 60 wt. parts of the acidic precursor is typically present in the polymer.

E) Other monofunctional precursor: The other monofunctional precursor contains one polymerizable, ethylenically unsaturated functional group. It functions to further adjust the properties of layer 16, e.g., flexibility and glass transition temperature, and as a polymerizable co-solvent for the components of the liquid polymerizable mixture used to form the layer. The term "other monofunctional precursor" excludes the ammonium precursors, organo-silicone precursors and acidic precursors, each of which may also contain only one polymerizable, ethylenically unsaturated functional group.

The other monofunctional precursor typically is a low viscosity liquid. When the polymerizable mixture is to be coated as a solution, the other monofunctional precursor typically contains a hydrophilic group. Typical useful other monofunctional precursors include, for example, N-vinyl pyrrolidone, 2-hydroxyethyl acrylate, tetrahydrofurfuryl acrylate, 2-hydroxyethyl methacrylate, tetrahydrofurfuryl methacrylate, 2-hydroxypropyl acrylate, 2-(2-ethoxyethoxy) ethyl acrylate, 2-cyanoethyl acrylate, and 2-hydroxypropyl methacrylate. When an other monofuctional precursor is used in the preparation of the polymeric material, about 10 to 50 wt. parts of the material typically are present in the polymer.

F) Other components: The composition may comprise a photoinitiator to facilitate copolymerization of the mixture. When the polymerizable mixture is to be cured by irradiation with ultraviolet radiation, it may comprise a free radical generating initiating system activatable by ultraviolet radiation. When the mixture is to be cured by electron beam irradiation, a photoinitiating system is not required.

Suitable photoinitiating systems have been described in "Photoinitiators for Free-Radical-Initiated Photoimaging Systems," by B. M. Monroe and G. C. Weed, Chem. Rev., 93, 435–448 (1993) and in "Free Radical Polymerization" by K. K. Dietliker, in Chemistry and Technology of UV and EB Formulation for Coatings, Inks, and Paints, P. K. T. Oldring, ed, SITA Technology Ltd., London, 1991, Vol. 3, pp. 59–525. Preferred free radical photoinitiating compounds include benzophenone; 2-hydroxy-2-methyl-1-phenylpropan-1-one (Darocur® 1173); 2,4,6-trimethylbenzolyl-diphenylphosphine oxide (Lucerin® TPO); 2,2-dimethoxy-2-phenyl-acetophenone (benzildimethyl ketal, BDK, Irgacure® 651, Lucirin® BDK); 2-methyl-1-[4-(methylthio)phenyl]-2-morpholinopropanone-1 (Irgacure® 907); 1-hydroxycyclohexylphenyl ketone (HCPK, Irgacure® 184); bis(2,6-dimethoxybenzolyl)-2,4,4-trimethylpentylphosphine oxide; and combinations thereof. Preferred mixed photoinitiators include a 50:50 blend of 2-hydroxy-2-methyl-1-phenylpropan-1-one and 2,4,6-trimethylbenzolyldiphenylphosphine oxide (Darocur® 4265); and a 25:75 blend of bis(2,6-dimethoxybenzolyl)-2,4,4-trimethylpentylphosphine oxide and 2-hydroxy-2-methyl-1-phenylpropan-1-one (CGI 1700).

Before irradiation, the unpolymerized material typically contains about 1 to 10 parts by weight, more typically about 3 to 8 parts by weight, of the photoinitiator, based on the total weight of the polymerizable materials.

The composition may also comprise particles of a matting agent to provide a matte finish to the conductive layer. Particles of average diameter in the range of about 1 μm to about 15 μm are suitable. Typically 1 to 20 wt. %, preferably 5 to 15 wt. %, of matting agent is present in the composition. A preferred matting agent is amorphous silica.

Base

Base 18 functions as a support to the superposed layers. It may be any web or sheet material possessing suitable flexibility, dimensional stability, and adherence to electrically conductive polymeric release layer 16. The base typically has a resistivity of about 1 to 30 meg-ohm/□.

Suitable web or sheet materials for the base are flexible polymeric films, such as polyethylene terephthalate film, or a foraminous material, such as a paper sheet, treated to be electrically conductive or semi-conductive. Other suitable materials are metal foils, metalized polymeric films, such as polyethylene terephthalate films having a metallic coating thereon, conductive paper sheeting, and the like. The web or sheet may also be surface treated or coated with a material to enhance desired surface characteristics.

Back Side Conductive Layer

Figure 2B:
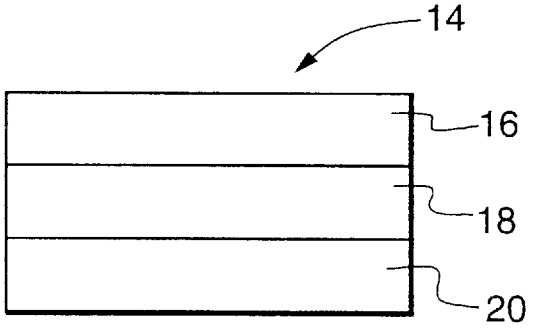

The support structure may also comprise a back side conductive layer. Referring to FIG. 2*b*, support structure 14 comprises electrically conductive polymeric release layer 16, base 18, and optional back side conductive layer 20. Back side conductive layer 20 preferably comprises a film-forming material which may be an organic material, e.g., such as a cation type styrene-methacrylate copolymer having an electrical resistivity of about 1 to 30 meg-ohm/□. Other suitable film-forming, organic materials include polymeric quaternary ammonium compounds, polystyrene sulfonic acid, polymeric matrices capable of ionizing inorganic electrolytes contained therein, and the like. The film-forming, organic material may be used alone or with conductive, inorganic materials and/or metals dispersed therein, e.g., such as tin oxide, aluminum and the like.

Imaging Layer Structure

Figure 3A:
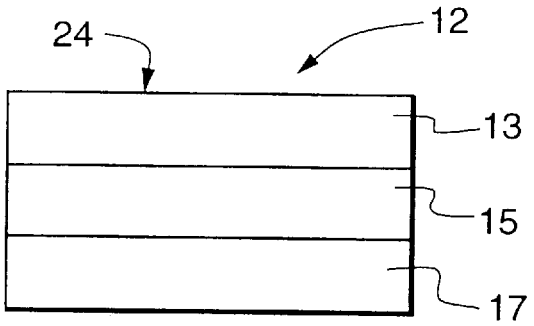
FIGS. 3*a* and 3*b* are schematic representations of the imaging layer structure of electrographic imaging elements of this invention.

Referring to FIG. 3*a*, imaging layer structure 12 of the electrographic imaging element comprises adhesive layer 13 with imaging surface 24, dielectric layer 15, and protective layer 17.

Adhesive Layer

Adhesive layer 13 functions to permanently adhere the image to a receptor following formation of the latent electrostatic image and toning to produce the image. Adhesive layer 13 comprises a substantially tack-free, thermal adhesive that is activated at a pressure and a temperature above the normal ambient pressure and temperature of the imaging element prior to use. The adhesive may be chosen from a variety of conventional thermal adhesive materials. Typically, the thermally activated adhesive material is comprised of thermoplastic polyurethanes; polycaprolactone; acrylic copolymers; and combinations thereof. Representative thermally activated adhesive materials include Morthane® CA-116 urethane resin (Morton International); Tone® Polymer P767E biodegradable plastic resin (Union Carbide); and Elvax® 240 vinyl resin (Du Pont Chemicals). Adhesive layer 13 is transparent in at least one region of the visible spectral region and typically is transparent throughout the visible spectral region. Adhesive layer 13 typically has a thickness of about 2–6 μm, preferably about 3–4 μm.

Adhesive layer 13 may comprise photostablizers that protect both the layer and the underlying image from damage by ultraviolet light. Typically photostabilizers include materials that strongly absorb ultraviolet radiation, such as 2-hydroxybenzophenones, oxalanilides, aryl esters and the like, as well as hindered amine light stabilizers, such as bis(2,2,6,6-tetramethyl-4-piperidinyl) sebacate (Tinuvin® 770) and the like; and combinations thereof. Materials that do not absorb strongly in the visible region of the spectrum are preferred.

Imaging surface 14 of adhesive layer 13 may be rough to ensure good transfer of charge during passage of the element under the stylus bar during imaging. This roughness can be obtained by including in the layer particles sufficiently large to give surface irregularities to the layer. Particles of diameter in the range of about 1 μm to about 15 μm are suitable. Particle composition and size are chosen to give the required dielectric constant to the layer as well as the appropriate surface topography and abrasive properties to the layer.

Dielectric Layer

Dielectric layer 15 may be any conventional film-forming material with a dielectric constant of about 2 to about 5. The dielectric layer typically comprises one or more polymers selected from polyvinylacetate, polyvinylchloride, polyvinylbutyral, polymethylmethacrylate, styrenated acrylics, styrene acrylonitrile, and similar materials. Other ingredients may be chosen from waxes, polyethylene, alkyd resins, nitrocellulose, ethyl cellulose, cellulose acetate, shellac, epoxy resins, styrene-butadiene copolymers, chlorinated rubbers, polyacrylates, and the like. Dielectric layer 15 typically has a thickness of about 1 μm to about 20 μm, preferably about 3 μm to about 10 μm.

Combined Dielectric/Adhesive Layer

Figure 3B:
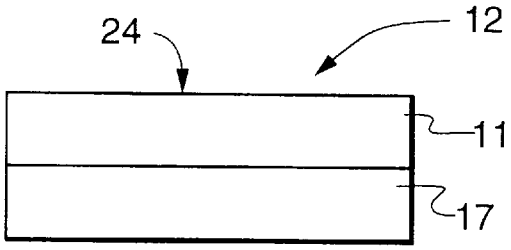

In a preferred embodiment, the electrographic imaging element comprises a combined dielectric/adhesive layer that is substantially tack-free at ambient temperature and whose adhesive properties are activated at a temperature above ambient. Referring to FIG. 3*b*, imaging layer structure 12 of the electrographic imaging element comprises combined dielectric/adhesive layer 11 and protective layer 17. Combined layer 11 typically comprises one or more polyesters; polyurethanes; polyamides; polyolefins; polycarbonates; polystyrenes; and/or polymers or copolymers of acrylic or methacrylic acids, esters, amides, or the like (such as polymethylmethacrylate), styrenes, acrylonitriles, vinyl esters, alkyd substituted vinyl esters, vinyl alcohol, vinyl acetals (e.g., polyvinyl butyral), vinyl chloride, vinyl fluoride, vinylidene chloride, 1,4-dienes (e.g., butadiene, isoprene and the like); ethylene/vinyl alcohol copolymers; copolymers of styrene with acrylic and methacrylic monomers; modified cellulosic resins such as cellulose acetate and cellulose acetate butyrate; block copolymer thermoplastic rubbers (e.g., styrene/ethylene/butylene/styrene block copolymer); and blends of the above. Elements comprising a combined dielectric/adhesive layer are disclosed in Cahill, U.S. Pat. No. 5,483,321, incorporated herein by reference. As described above, the combined dielectric/adhesive layer is transparent in at least one region of the visible spectrum, and may comprise photostabilizers and/or particles in the range of about 1 μm to about 15 μm. Layer 11 typically has a thickness of about 1 μm to about 20 μm, preferably about 3 μm to about 10 μm.

Protective Layer

Protective layer 17 is a polymeric film material which is resistant to scratching and abrasion as well as to environmental components and contaminants. It is permanently adhered to dielectric layer 15 or to combined dielectric/adhesive layer 11, but is removably adhered to electrically conductive release layer 16.

Protective layer 17 is transparent in at least one region of the visible spectral region and typically is transparent throughout the visible spectral region. Polymeric materials useful in making this layer include polyvinyl chloride; polyvinyl butyral; cellulose acetate proprionate; cellulose acetate butyrate; polyesters; acrylics; polyurethanes; styrene copolymers, such as styrene/acrylonitrile; fluoropolymers; and combinations thereof. Protective layer 17 may also contain photostabilizers, such as those described above. To prevent distortion of the underlying image when it is viewed through the protective layer, materials that do not absorb strongly in the visible region of the spectrum are preferred.

At times it is desired to provide a range of surface finishes from highly glossy to matte. This may be done by controlling the outermost surface of protective layer 17. This surface replicates the surface of the release layer with which it is in contact prior to lamination and separation, as discussed later on in this description. Thus if the release layer has a rough texture, or contains any other relief pattern, the final image will appear matte, and if the release layer surface texture is smooth, the final image will be glossy.

Alternatively, protective layer 17 may be provided with a matte surface. This matte surface can be obtained by including in the layer particles sufficiently large to give surface irregularities to the layer. Particles of average diameter in the range of about 1 μm to about 15 μm are suitable. This layer typically has a thickness in the range of about 0.5 μm to about 10 μm and preferably in the range of about 1 μm to about 4 μm. A preferred matting agent is amorphous silica.

A preferred protective layer consists essentially of a fluoropolymer and an acrylic polymer. Fluoropolymer refers to polymers whose structure comprises fluorine atoms covalently bonded to carbon atoms. As is well known to those skilled in the art, such polymers can be prepared by polymerization of fluorinated monomers, such as tetrafluoroethylene, hexafluoropropylene, vinylidene fluoride, perfluorovinyl ethers, and vinyl fluoride, with each other and/or with non-fluorinated monomers, such as ethylene.

Fluoropolymers that may be used in the protective layer are those that can be coated from a homogenous solution and yet have a relatively low surface energy. The fluoropolymer must be sufficiently soluble in a coating solvent that a homogeneous coating solution comprising the fluoropolymer and the acrylic polymer can be formed. The coating solvent must be fugitive, that is, it must have a sufficiently high vapor pressure that it can be removed following coating of the protective layer. Preferred coating solvents are fugitive ketones, such as acetone, methyl ethyl ketone, methyl propyl ketone, methyl butyl ketone, methyl i-butyl ketone, and cyclohexanone. Small amounts of fugitive co-solvents may be used, provided that the ability of the solvent to form a homogeneous coating solution comprising the fluoropolymer and the acrylic polymer is not adversely affected.

The fluoropolymer should have a surface energy of 16 to 30 dynes/cm. This surface energy is sufficiently low to provide the layer with the desired protective properties. Copolymers of vinylidene fluoride and tetrafluoroethylene may be used. Fluoropolymers having a high content of vinylidene fluoride (i.e., greater than 30% by weight) have good stability in organic solvents. As a result, the application and formation of a coherent sealing film is facilitated without causing damage to the underlying layers of the element. A preferred fluoropolymer is Kynar® SL, a copolymer of vinylidene fluoride and tetrafluoroethylene. Polymers of perfluorovinyl ethers, sold under the tradename of Lumiflon® (ICI Americas, Wilmington, Del.), may also be useful.

In combination with certain concentrations of acrylic polymers, fluoropolymers attain good adhesive quality to the combined adhesive and dielectric layers of the electrographic element without apparent loss of their advantageous protective qualities. The acrylic polymer should be compatible with the fluoropolymer. Useful acrylic polymers include polymers and copolymers of esters of acrylic acid and methacrylic acid, such as methyl acrylate, methyl methacrylate, ethyl acrylate, ethyl methacrylate, propyl acrylate, propyl methacrylate, butyl acrylate, butyl methacrylate, and similar monomers. These materials can be prepared by polymerization techniques well known to those skilled in the art and are sold under of a variety of tradenames, including Acryloid® (Rohm and Haas) and Elvacite® (Du Pont). A preferred acrylic polymer is Acryloid® A-101, methyl methacrylate acrylic polymer.

A protective layer comprising a mixture of a fluoropolymer and acrylic polymer at weight ratios ranging from about 65:35 to about 85:15, fluoropolymer to acrylic polymer, provides adequate protection from hazards as well as good adhesion. A ratio of about 75:25, fluoropolymer to acrylic polymer, is preferred. The protective layer typically has a dry thickness of about 0.5 to 5 micrometers, preferably about 1.0 to 2.0 micrometers. The protective layer should have a surface energy less than 50 dynes/cm, preferably less than 45 dynes/cm, more preferably less than 40 dynes/cm.

Figure 4:
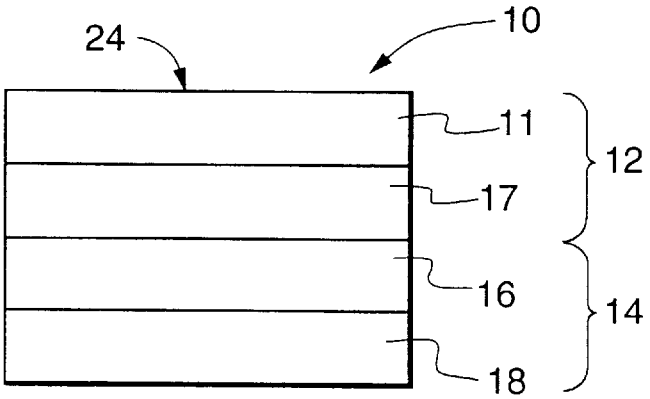
FIG. 4 is a schematic representation of a preferred electrographic imaging element of this invention.

Referring to FIG. 4, a preferred embodiment of imaging element 10, suitable for use in electrographic imaging processes, comprises imaging layer structure 12, made up of combined dielectric/adhesive layer 11, and fluoropolymer/acrylic protective layer 17, and support structure 14, made up of electrically conductive release layer 16, and base 18.

Element Preparation

Electrographic element preparation will be described with reference to the preferred embodiment depicted in FIG. 4. Those skilled in the art will readily appreciate that elements comprising additional or different layers can be prepared by appropriate modifications of this procedure.

Electrically conductive release layer 16 is prepared by coating a liquid mixture comprising the precursors onto base 18 and, following coating, curing the layer either with ultraviolet or with electron beam radiation.

The liquid precursor mixture typically is coated as a solution or a dispersion of the components in the coating solvent. When the liquid mixture is coated as a dispersion the coated dispersion typically is hazy. The coated dispersion, upon curing, typically forms a transparent, continuous, defect-free, polymeric film. In addition, metastable dispersions may be used when separation time of the components is in hours and the dispersion is stirred before and during coating.

In some instances, if necessary, a coupling solvent can be added to form a solution, so that the liquid mixture may be coated as a solution. Typically about up to about 40 weight parts of the fugitive coupling solvent may be added to the liquid mixture. "Fugitive coupling solvent" refers to water, a water miscible organic solvent, or a mixture thereof, which is lost after the cure. Unlike solvent based coating solutions where the solvent forms a major component of the solution, the coating solutions require only a limited amount of coupling solvent to form a single phase solution. Typically, the coupling solvent is removed from the coating during or after curing. Useful coupling solvents include diethylene glycol monoethyl ether, diethylene glycol monobutyl ether, tetrahydrofurfurylalcohol, γ-butyrolactone, 1-methoxy-2-propanol, and combinations thereof.

The liquid mixtures are coatable by a variety of well known techniques, such as: laboratory manual coating and full scale production machine coating including coating with wire wound or smooth (#0) Mayer rods; direct gravure or offset gravure, which are especially useful for depositing very low coating weight in the order of 0.2 to 5 $g/m^2$; and roll, slot, spray, dip and curtain coating and the like. Although the viscosity of the liquid mixture may vary widely depending on the coating method, typically coating viscosity is from about 300 to about 2000 cps. at 25° C.

"Cure" refers to polymerization and/or crosslinking of the ethylenically unsaturated precursors by the free-radical addition process. Cure is accomplished by exposing a photoinitiator containing coating to intense ultraviolet light sources such as those available from AETEK International (Plainfield, Ill.) or Fusion U.V. Curing Systems, Inc. (Rockville, Md.). Exposure may be carried out either in sheet form, as in the AETEK laboratory units, or in continuous web form, as on production scale coating machines having an ultraviolet curing station following the coating head. The conditions to obtain complete dry-to-touch through cure will depend upon a number of factors such as the nature and amount of ammonium precursor present, oligomer content, crosslinking precursor concentration, nature and amount of other polymerizable components present, nature and amount of photoinitiator present, coating thickness, line speed and lamp intensity, and the presence or absence of an inert atmosphere.

Protective layer 17 is coated over cured dielectric/release layer 16. The fluoropolymer/acrylic resin layer protective coating is applied using a fugitive solvent. A suitable fugitive solvent is methyl ethyl ketone, although other solvents, such as ethyl acetate as well as acetone and other fugitive ketone can be used.

Combined dielectric/adhesive layer 11 is coated over protective layer 17. Alternatively, if an element that does not comprise a protective layer is desired, combined dielectric/adhesive layer 11 may coated directly over cured electrically conductive release layer 16. Preparation of elements comprising a combined dielectric/adhesive layer is described in Cahill, U.S. Pat. No. 5,483,321.

Image Formation

Referring to FIG. 1, the image is produced by forming a latent image of charge on imaging surface 24 of imaging element 10, toning the latent image, laminating a receptor to imaging surface 24, and removing support structure 14 to from image comprising, in order, imaging layer structure 12, the toned image, and the receptor. Image formation will be described with respect to the preferred electrographic element depicted in FIG. 4.

A latent image is first formed by charge deposition on the surface of combined dielectric/adhesive layer 11. The latent image is then toned with an appropriate toner. Any conventional electrographic process may be used to form such image and to apply toner particles. Electrographic processes, and the associated apparatus, are disclosed in Helmberger, U.S. Pat. No. 4,007,489; Doggett, U.S. Pat. No. 4,731,542; and St. John, U.S. Pat. No. 4,569,584.

When a multi-colored image is desired, the imaging and toning steps are repeated with additional toners of different colors, in either sequentially arranged imaging and toning stations or by passing the element under the same imaging station and replacing the toner in the toning station. Color reproduction usually requires three and preferably four different color toners to render a pleasing and accurate facsimile of an original color image. The selection of toner colors and the creation of the different images whose combination will provide such accurate rendition of an original image is well known in the art.

After the image has been produced, a receptor is laminated to the surface of the imaged electrographic element under an applied pressure of about 0.5 kg/cm$^2$ (7 p.s.i.) to about 100 kg/cm$^2$ (1422 p.s.i.) or more to form an element consisting of, in order, base 18, polymeric release layer 16, protective layer 17, combined dielectric/adhesive layer 11, the toned image, and the receptor. Suitable means that may be used to apply pressure include platen presses; counterpoised, double roll, laminating devices; scanning, single roll, laminating devices; vacuum laminating devices; and the like. When the receptor has an air impervious surface, roll laminating devices are preferred because they readily minimize air entrapment between the image and the receptor. Vacuum may be used to eliminate air entrapment. When the receptor is rigid and roll laminating devices are used, the imaged electrographic element typically is pressure laminated to the receptor.

The receptor typically functions as the final support for the imaged electrographic element. The receptor may be any surface upon which an electrographic image is desired. Typically, it is a web or sheet material possessing dimensional stability and adherence properties to the activated adhesive properties of combined dielectric/adhesive layer 11. It may be a flexible polymeric film, such as polyethylene terephthalate film; a foraminous material, such as a paper or textile fabrics; metal films or webs, such as aluminum, steel, tin-plate; or any composites or laminates thereof. The receptor may also be a rigid or semi-rigid sheeting or plate, such as sheeting or plates of metal, glass, ceramic, plastic, cardboard, or any composites or laminates thereof. It may vary in size from that of a photographic print, e.g., having an area of about 30 cm$^2$ or less, to that of banners and billboards, e.g., having an area of about 70 m$^2$ or greater. The receptor may be surface treated or coated with a material to enhance desired surface characteristics.

Lamination produces strong adhesion between the toned electrographic element and the receptor. Heat is used during lamination to raise the temperature of combined dielectric/adhesive layer 11 from ambient temperature (e.g., room temperature), where it is substantially tack-free, to a temperature at which the adhesive properties are activated. Heat may be applied prior to and/or concurrently with the application of pressure. For example, combined dielectric/adhesive layer 11 and the receptor may be heated by radiant or contact heaters and then laminated while hot. Alternatively the pressure means itself may also function as a heater, such as a hot roll laminator, or both prior and concurrent heating may be used in combination. Preferably, a laminating temperature of about 100° C. or greater is employed.

Next the support structure, comprising base 18 and electrically conductive release layer 16, is removed from the element formed by lamination, exposing protective layer 17. Typically, base 18 is peeled with a peel force directed at an angle of 90° or more from the surface of protective layer 17. The peel rate and the peel force are not critical and preferred values will depend on the nature of the conductive and carrier materials. The temperature at which the support structure is peeled from the protective layer will depend on the properties of the electrically conductive release layer 16. The support structure can be removed about 1 minute or less, and preferably between about 1 second and about 20 seconds, after lamination without delamination of the protective layer or any of the other component layers.

In the preparation of the final image, it is sometimes preferred to keep the support structure in place on the imaged electrographic element throughout storage and processing in order to prevent any damage or marring to the underlying layers. Removal of the base layer is the very last step in preparing and mounting the protected electrographic image. In this instance, the support structure can be removed at room temperature delamination of the protective layer.

Those skilled in the art will readily appreciate that images may be prepared from elements comprising additional or different layers by appropriate modifications of this procedure. For example, if the element comprises adhesive layer 13 and dielectric layer 15, such as the element depicted in FIG. 3*a*, instead of combined dielectric/adhesive layer 11, the latent image is formed by depositing the charge on imaging surface 24 of adhesive layer 13, toning the latent image, laminating a receptor to imaging surface 24 to form an element consisting of, in order, base 18, polymeric release layer 16, protective layer 17, dielectric layer 15, adhesive layer 13, the toned image, and the receptor. Removing support structure 14 forms an image comprising, in order, protective layer 17, dielectric layer 15, adhesive layer 13, the toned image, and the receptor.

Industrial Applicability

The elements are useful for the production of images, especially colored images, by electrographic processes. Electrographic imaging is particularly useful for forming large size images, such as are required for banners, billboards, and other out-of-doors advertisements.

EXAMPLES

Glossary

| Glossary | |
|---|---|
| Acrylic resin E-342 | Solvent based modified acrylic copolymer (Rohm and Haas, Philadelphia, PA) |
| Acryloid ® A-101 | 40% solids methyl methacrylate acrylic polymer in methyl ethyl ketone (Tg = 105° C.) (Rohm and Haas, Philadelphia, PA) |

-continued

| Glossary | |
|---|---|
| Ageflex ® FA1Q80MC | 80% 2-Acryloyloxyethyltrimethylammonium chloride in water (CPS Chemical, Old Bridge, NJ) |
| Ageflex ® FA1Q80DMS | 80% 2-Acryloyloxyethyltrimethylammonium dimethylsulfate in water (CPS Chemical, Old Bridge, NJ) |
| Butvar ® B-76 | Polyvinyl butyral (weight ave. molecular weight: 90,000–120,000) (Monsanto, St. Louis, MO) |
| β-CEA | β-Carboxyethyl acrylate |
| Darocur ® 1173 | 2-Hydroxy-2-methyl-1-phenylpropan-1-one (Ciba Geigy, Hawthorne, NY) |
| DMDAC | Dimethyldiallylammonium chloride |
| Dowanol ® PM | Propylene glycol monomethyl ether (Dow Chemical, Midland, MI) |
| Ebecryl ® 350 | Polyacrylated polydimethylsiloxane-polyether copolymer having a viscosity of 200–300 centipoise at 25° C. (U. C. B. Radcure, Smyrna, GA) |
| Ebecryl ® 810 | Tetrafunctional polyesteracrylate (U. C. B. Radcure, Smyrna, GA) |
| Ebecryl ® 1360 | Hexaacrylate of a polydimethyl-siloxane-polyether copolymer having a viscosity of 1000–3000 centipoise at 25° C. (U. C. B. Radcure, Smyrna, GA) |
| Ebecryl ® 1608 | Bisphenol A epoxy acrylate & 20% propoxylated glycerol triacrylate (U. C. B. Radcure, Smyrna, GA) |
| Ebecryl ® 3200 | Blend of aliphatic and aromatic acrylated epoxy resins (U. C. B. Radcure, Smyrna, GA) |
| 2-HEA | 2-Hydroxyethyl acrylate |
| Hydrocarb ® PG3 | Wet ground calcium carbonate, average particle size of 3 μm (OMYA, Proctor, VT) |
| MAPTAC | (3-(Methacryloylamino)propyl)trimethyl-ammonium chloride |
| OK 412 | Organic surface treated silica, particle size 5.0 to 7.0 microns (Degussa, Ridgefield Park, NJ) |
| SR 256 | 2-(2-Ethoxyethoxy)ethyl acrylate (Sartomer, West Chester, PA) |
| SR 285 | Tetrahydrofurfuryl acrylate (Sartomer, West Chester, PA) |
| PETA | Pentaerythritol triacrylate |
| Photomer ® 5018 | Tetrafunctional polyester acrylate (Henkel, Ambler, PA) |
| Piccolastic ® A-5 | Low molecular weight polystyrene (Hercules, Wilmington, DE) |
| Syloid ® 74 | Amorphous silica slurry, average particle size 9 μm (Davison Chemical Division, W. R. Grace, Baltimore, MD) |
| TMPEOTA | Trimethylolpropane ethoxylate triacrylate |

Polymer Characterization

Polymer electrical conductivity is expressed as the surface resistivity of a film of the polymeric material coated on a base, and is expressed in "ohms per square" (Ω/□). Unless otherwise specified, the following procedures were used to characterize the polymeric materials.

Surface resistivity measurements were made under TAPPI conditions, i.e., at 50% relative humidity at 73° F. (23° C.), as measured with a probe having a 6.0 inch (about 15.2 cm)×6.0 inch (about 15.2 cm) area between two 0.50 $in^2$ (about 3.2 $cm^2$) square cross-section brass bars connected to a General Radio 1864 Megohmmeter. Each polymeric coating was cut to fit the outside dimensions of the probe and conditioned at 50% relative humidity at 73° F. (23° C.) for about 1 to 2 hr. before measurement was made.

Surface release characteristic was determined using a Scotch® brand 610 (610 tape) (3M, St. Paul, Minn.) pressure sensitive contact-adhesive tape (a widely accepted standard for film adhesion testing) and a film of the polymeric material coated on a base. Surface release measurements were made as follows: An 8 in (20.3 cm) long, 1 in (2.54 cm) wide strip of 610 tape was adhered to the surface of the coated polymeric sheet and the excess sheet trimmed from around the adhered tape. The tape was peeled from the coated polymeric sheet at an angle of 180° a rate of about 25 cm/min using an Instron tester and the peel force required noted. Alternatively, when quantitative measurements were not required, the tape may be stripped manually at an angle of 180° and the relative ease of removal noted. In each instance the surfaces of the polymeric coating and of the adhesive of the stripped tape were inspected for any transfer of adhesive material to the coating surface, or transfer of polymeric material to the tape.

Surface topography of a coated polymeric material depends upon several factors, e.g., coating fluid viscosity, coating thickness, base roughness, penetration, and the specific coating method used. Surface topography influences the reflectivity of a film of the polymeric material, i.e., its gloss level. Surface gloss measurements were made using a Gardner Laboratory Glossgard II 75° Glossmeter, which measures the amount of specular reflectance of a beam of light from a surface in which the beam of light is incident on the surface at an angle of 75° from the surface plane. Sheffield surface roughness was measured using a Giddiness & Luis Smoothcheck Apparatus.

Viscosity measurements were made using a Brookfield LVT Viscometer with Spindle No. 3 at 30 rpm, and at about 72° F. (22° C.).

Example 1

This example illustrates preparation and imaging of an electrographic element.

To prepare combined electrically conductive release layer 16, a conductive/release coating composition was prepared by mixing the following ingredients with a Lightnin® Mixer.

| Amount (%) | Ingredient |
|---|---|
| 32.8 | Ageflex ® FA1Q80MC |
| 19.9 | β-CEA |
| 19.9 | TMPEOTA |
| 19.9 | Ebecryl ® 1608 |
| 0.5 | Ebecryl ® 350 |
| 5.0 | Darocur ® 1173 |

The composition was coated onto 63 $g/m^2$ opaque conductive paper (Product OLP, Otis Specialty Papers, Jay, Me.) by reverse gravure at a coated weight of 3.0 $g/m^2$. The coating was cured using one pass at 100 ft/min (50 cm/sec) under two 300 watts/in (about 125 watts/cm) mercury lamps. An element consisting of electrically conductive release layer 16 and base 18 was produced. Electrically conductive release layer 16 had a 75° gloss of 90–95% and a surface resistivity of 1.5 Mohm/□ at 50% relative humidity and 23° C. The surface energy was about 23 dyne/cm.

Combined transparent dielectric/adhesive 11 was prepared from the following ingredients.

| Ingredient | Parts by Weight |
|---|---|
| Ethanol | 120 |
| Acetone | 440 |
| Toluene | 720 |
| Butvar ® B-76 | 130 |
| Acrylic Resin E-342 | 440 |
| Syloid ® 74 | 20 |
| Hydrocarb ® PG3 | 175 |
| Piccolastic ® A-5 | 52 |

The first three listed ingredients were added to a Kady mill and the Butvar® was stirred in. After 15 min. of mixing the acrylic resin and the polystyrene were added. After a further 5 min. of mixing, the calcium carbonate and the amorphous silica were added and the mixing continued for 10 min. The resulting mixture was applied to electrically conductive release layer 16 by reverse roll coating and dried at 115°–130° F. (about 46°–54° C.) to give a dry coat weight of 5 g/m$^2$. A element consisting of base 18, electrically conductive release layer 16, and combined transparent dielectric/adhesive 11 was produced. The Sheffield surface roughness was 75 to 80 sec/100 mL. The dielectric coating could be completely removed from electrically conductive release layer 16 by mild pulling with Scotch® Brand Magic Tape (810 tape) (3M, St. Paul, Minn.).

The electrographic element was moisturized to a level of about 6% by weight and a four color image layer was deposited on combined transparent dielectric/adhesive 11 using a Raster Graphics DCS 5400 printer (Raster Graphics, San Jose, Calif.) and standard toners and plotting conditions. A high quality four color image was produced.

The imaged element was laminated onto a receptor by first laying the imaged electrographic element on a receptor sheet of ScotchCal® 7725 pressure sensitive vinyl (3M Commercial Graphics, St. Paul, Minn.) with the toned image in contact with the receptor sheet. This composite was then passed through the hot nip of an Orca® III hot nip laminator (Pro-Tech Engineering, Madison, Wis.) at a speed of 2 ft/min (0.61 m/min), 240° F. (116° C.) and a cylinder pressure of 100 psi (7.03 Kg/cm$^2$). The support base was removed approximately 10 sec. after the laminated composite was removed from the hot nip. The toned image transferred completely. It had a 75° gloss of 80 to 90%.

Example 2

This example illustrates preparation and imaging of an electrographic element. Electrically conductive release layer 16 was cured in an oxygen depleted atmosphere to produce a glossy product.

The electrically conductive release coating composition described in Example 1 was coated onto 60 g/m$^2$ opaque conductive paper (Product DR Base, Otis Specialty Papers, Jay, Me.) by reverse gravure with a 200 RBH gravure cylinder at a coated weight of 3.1 g/m$^2$. The coating was cured under 600 watts/in (about 250 watts/cm) ultraviolet irradiation at 900 ft/min (about 460 cm/sec) in an inerted atmosphere (oxygen concentration less than 50 ppm). An element consisting of electrically conductive release layer 16 and base 18 was produced. Electrically conductive release layer 16 had a 75° gloss of 92–95% and a surface resistivity of 1.6 Mohm/□ at 50% relative humidity and 23° C. The surface energy was about 23 dyne/cm.

Combined transparent dielectric/adhesive 11 was prepared as described in Example 1 and coated onto electrically conductive release layer 16 with a #16 Mayer rod to produce an element consisting of base 18, combined conductive/release layer 16, and combined transparent dielectric/adhesive layer 11. The dielectric coating could be readily removed from electrically conductive release layer 16 by mild pulling with 810 tape.

Rolls of the electrographic element were moisturized to a level of from 6 to 7% by weight. A four color toned image layer was deposited on combined transparent dielectric/adhesive layer 11 using a Versatec® 8944 Color Electrostatic Printer (Xerox ColorgrafX Systems, San Jose, Calif.) using standard toners and coating conditions.

The imaged element was laminated onto a receptor of ScotchCal® 7725 pressure sensitive vinyl as described in Example 1. The toned image transferred completely.

Example 3

This example illustrates preparation and imaging of an imaging element using a conductive release coating with a glossy finish.

The following composition was prepared and coated onto Otis OLP conductive paper by reverse gravure using a laboratory scale web coater. The coating was cured by a exposure to two 300 watt ultraviolet lamps (about 120 watts/cm) at a speed of about 18–20 cm/sec.

| Component | Parts |
|---|---|
| Ageflex ® FA1Q80MC | 75 |
| Ebecryl ® 1608 | 20 |
| Darocur ® 1173 | 4 |
| Ebecryl ® 350 | 1 |

Surface resistivity was 3.9×10$^6$ Ω/□. Gloss was 91%. Sheffield surface roughness was 50 sec/100 mL. Surface energy was about 23 dyne/cm.

The dielectric/adhesive layer described in Example 1 was coated onto the conductive layer as described in Example 1. Black and white images were prepared and transferred to an adhesive substrate as described in Example 2. The toned image transferred completely. The image had acceptable image density, gloss, and aesthetic properties.

Example 4

This example illustrates preparation and imaging of an imaging element using a conductive release coating with a matte finish.

The following composition was prepared, coated, and evaluated by the procedure described in Example 3.

| Component | Parts |
|---|---|
| Ageflex ® FA1Q80MC | 70 |
| Ebecryl ® 1608 | 19 |
| Darocur ® 1173 | 4 |
| Ebecryl ® 350 | 1 |
| OK 412 | 6 |

Surface resistivity was 5.3×10$^6$ Ω/□. Gloss at 75° was 27%. Sheffield surface roughness was 80 sec/100 mL. Surface energy was ab out 23 dyne/cm. The conductive coating was overcoated with a dielectric layer, imaged, and the image transferred as described in Example 3. The toned image transferred completely. The image had acceptable image density, gloss, and aesthetic properties.

Example 5

This example illustrates preparation and imaging of an electrographic element. Electrically conductive release layer 16 was cured in an oxygen depleted atmosphere to produce a matte product.

The electrically conductive release coating composition described in Example 2was coated onto 60 g/m$^2$ opaque conductive paper (Product DR Base, Otis Specialty Papers, Jay, Me.) by direct gravure with a 180 RBH gravure cylinder at a coated weight of 2.3 g/m$^2$. The coating was cured under 300 watts/in (about 125 watts/cm) ultraviolet irradiation at 500 ft/min (about 250 cm/sec) in an inerted atmosphere (oxygen concentration less than 50 ppm). An element consisting of electrically conductive release layer 16 and base 18 was produced. Electrically conductive release layer 16 had a 75° gloss of 45–50% and a surface resistivity of 1.4 Mohm/□ at 50% relative humidity and 23° C. The surface energy was about 23 dyne/cm.

Combined transparent dielectric/adhesive 11 was prepared as described in Example 1 and coated onto electrically conductive release layer 16 with a #16 Mayer rod to produce an element consisting of base 18, electrically conductive release layer 16, and combined transparent dielectric/adhesive layer 11. The dielectric coating could be readily removed from electrically conductive release layer 16 by mild pulling with 810 tape.

A four-color toned image layer was deposited on combined transparent dielectric/adhesive layer 11 as described in Example 4. The imaged element was laminated onto a receptor of ScotchCal® 7725 pressure sensitive vinyl as described in Example 1. The toned image transferred completely.

Example 6

This example illustrates preparation and imaging of an electrographic element. Electrically conductive release layer 16 was cured by an electron beam in an oxygen depleted atmosphere to produce a matte product.

The electrically conductive release coating composition described in Example 1 was coated onto 60 g/m$^2$ opaque conductive paper (Product DR Base, Otis Specialty Papers, Jay, Me.) by direct gravure with a 200 RBH gravure cylinder at a coated weight of 1.3 g/m$^2$. The coating was cured by electron beam radiation at 0.5 Mrad at 1000 ft/min (about 500 cm/sec) in an inerted atmosphere (oxygen concentration less than 50 ppm). An element consisting of electrically conductive release layer 16 and base 18 was produced. Electrically conductive release layer 16 had a 75° gloss of 19–20% and a surface resistivity of 1.5 Mohm/□. The surface energy was about 23 dyne/cm.

A four-color toned image layer was deposited on combined transparent dielectric/adhesive layer 11 as described in Example 4. The imaged element was laminated onto a receptor of ScotchCal® 7725 pressure sensitive vinyl as described in Example 1. The freshly formed toned image transferred completely.

Example 7

This example illustrates a precursor-rich formulation comprising a coupling solvent that can be used to form electrically conductive polymeric release layer 16.

The following composition gave a clear coating solution that was coated onto DR base using a #16 Mayer rod and cured using two passes at 100 ft/min (50 cm/sec) under two 300 watts/in (about 125 watts/cm) mercury lamps in an RPC laboratory ultraviolet processor.

| Grams | Component |
|---|---|
| 6.0 | 50 wt % aq MAPTAC |
| 5.0 | 2-HEA |
| 2.0 | PETA |
| 4.0 | Dowanol ® PM |
| 1.0 | Ebecryl ® 350 |
| 0.6 | Darocur ® 1173 |

A film surface that had very easy release from 610 tape was produced. The surface resistivity was 1.5–2.0×10$^6$ Ω/□ (the base paper alone was 2.5×10$^6$ Ω/□). The was gloss of 77% at 75°.

Example 8

This example illustrates a composition comprising oligomeric acrylates to improve cure rate and physical properties that can be used to form electrically conductive polymeric release layer 16.

A coating composition was prepared from the following components.

| Grams | Component |
|---|---|
| 7.5 | Ageflex ® FA1Q80MC |
| 2.0 | N-vinyl pyrrolidone |
| 6.0 | Pentaerythritoltriacrylate |
| 6.0 | 2-Ethoxyethoxyethylacrylate |
| 1.2 | Darocur ® 1173 |
| 0.16 | Ebecryl ® 350 |
| 2.0 | Water |

The coating composition was thoroughly shaken to obtain a dispersion which was coated on the DR base paper with a #6 Mayer rod and cured with two passes under two 400 watts per inch (about 160 watts/cm) mercury vapor lamps at a speed of 100 ft/min (about 50 cm/sec). The cured coating had a gloss of 89–92% at 75°, surface resistivity of 1.5–2.0×10$^6$ Ω/□, and gave easy 610 tape release.

Example 9

This example illustrates a composition that can be used to form electrically conductive polymeric release layer 16. A stable clear coating was prepared from the following components.

| Grams | Component |
|---|---|
| 7.50 | Ageflex ® FA1Q80MC |
| 10.0 | 2-Hydroxypropylacrylate |
| 4.0 | Pentaerythritol triacrylate |
| 1.2 | Darocur ® 1173 |
| 0.11 | Darocur ® 350 |
| 3.5 | Water |
| 2.0 | Butyl Carbitol ® |

The composition was coated with a #0 Mayer rod onto DR base and cured with two passes at 100 ft/min (50 cm/sec) using two 300 watts/in (125 watts/cm) mercury lamps. A glossy, dry, tack-free coating that had resistivity of 5.3×10$^5$ Ω/□ and readily released 610 tape was obtained.

The solution was coated onto non-conductive polyethylene terephthalate film (PET) using a #36 Mayer Rod and cured with three passes at 100 ft/min (50 cm/sec) using two 300 watts/in (125 watts/cm) mercury lamps. A dry, glossy 0.056 mm thick transparent coating was obtained having a resistivity of 5.3×10$^5$ Ω/□.

Example 10

This example illustrates a composition that can be used to form electrically conductive polymeric release layer 16. A very nearly clear coating solution was prepared from the following components.

| Grams | Component |
|---|---|
| 7.50 | Ageflex ® FA1Q80MC |
| 2.0 | Pentaerythritol triacrylate |
| 4.0 | N-Vinyl pyrrolidone |
| 0.16 | Ebecryl ® 350 |
| 0.75 | Darocur ® 1173 |
| 2.0 | Butyl Carbitol ® |

The composition was coated on DR base sheet with a #14 Mayer Rod and cured with two passes at 100 ft/min (50 cm/sec) under two 400 watts/in about 160 watts/cm) mercury lamps. The cured coating had 94% gloss at 75°, surface resistivity of $0.7–0.8\times10^6$ Ω/□, and good, complete 610 tape release.

Example 11

This example illustrates that some combinations of water miscible precursors that are immiscible with concentrated aqueous quaternary precursors can be used to form electrically conductive polymeric release layer 16 if limited dilution with water is made and surfactant type acrylated siloxanes are used both for release and dispersion. A coating mixture was prepared from the following components.

| Grams | Component |
|---|---|
| 7.5 | Ageflex ® FA1Q80MC |
| 2.0 | N-Vinyl pyrrol idone |
| 6.0 | Pentaerythritol triacrylate |
| 6.0 | 2-Ethoxyethoxyethylacrylate |
| 1.2 | Darocur ® 1173 |
| 0.1 | Ebecryl ® 350 |
| 2.0 | Water |

The mixture was thoroughly shaken to obtain a dispersion that was coated on the DR base with a #6 Mayer rod and cured as in Example 10. The cured coating had a gloss of 89–92% at 75°, surface resistivity of $1.5–2.0\times10^6$ Ω/□, and gave easy 610 tape release.

Example 12

This example illustrates use of a dispersion not employing extra water to provide a clear thin layer that can be used to form electrically conductive polymeric release layer 16. A coating mixture was prepared from the following components.

| Grams | Component |
|---|---|
| 7.5 | Ageflex ® FA1Q80MC |
| 6.0 | Tetrahydrofurfurylacrylate |
| 6.0 | Pentaerythritol triacrylate |
| 2.0 | N-Vinylpyrrolidone |
| 1.2 | Darocur ® 1173 + 10% benzophenone |
| 0.32 | Ebecryl ® 350 |

The mixture was coated on the DR base with a #0 Mayer rod and cured as in Example 10. The cured coating had 80% gloss at 75°, a surface resistivity of $2.5–4.5\times10^6$ Ω/□, and easy 610 tape release. A similar formulation, in which Ebecryl® 350 was used in place of 0.45 g Ebecryl® 1360 acrylated siloxane, also performed well.

Example 13

This example illustrates the use of a very high weight level of quaternary salt precursor to form a layer that can be used to form electrically conductive polymeric release layer 16. A coating mixture was prepared from the following components.

| Parts | Component |
|---|---|
| 10.0 | Ageflex ® FA1Q80MC |
| 2.0 | TMPEOTA |
| 0.50 | Darocur ® 1173 |
| 0.10 | Ebecryl ® 350 |
| 0.10 | Ebecryl ® 1360 |

The hazy dispersion was coated onto non-conductive Champion 60-lb litho paper with a #0 Mayer rod and cured as described in Example 10. The coating had a resistivity of $1.3\times10^5$ Ω/□.

Example 14

This example illustrates the facile polymerization of a typical dispersion lacquer using an electron beam and no photoinitiator to form a layer that can be used to form electrically conductive polymeric release layer 16. A coating mixture was prepared from the following components.

| Parts | Component |
|---|---|
| 264.0 | Ageflex ® FA1Q80MC |
| 160.0 | β-CEA |
| 160.0 | TMPEOTA |
| 176.0 | Ebecryl ® 1608 |
| 8.0 | Ebecryl ® 350 |
| 8.0 | Ebecryl ® 1360 |

The dispersion was coated onto DR base paper with a #0 Mayer rod and cured at four increasingly lower dose levels at 30 ppm oxygen. Even at the lowest dose, a full dry cure was obtained. The uncoated DR base paper has a resistivity of $2.5\times10^6$ Ω/□.

| Dose in Megarads | Resistivity (Ω/□) |
|---|---|
| 3 | $0.7–0.8 \times 10^6$ |
| 2 | $0.6–0.8 \times 10^6$ |
| 1 | $0.6–0.8 \times 10^6$ |
| 0.5 | $0.6–0.8 \times 10^6$ |

Example 15

This example illustrates use of a carboxylated precursor in conjunction with a quaternary salt conductivizing agent. A coating mixture was prepared from the following components:

| Parts | Component |
|---|---|
| 33.04 | Ageflex ® FA1Q80MC |
| 17.62 | β-carboxyethylacrylate |

-continued

| Parts | Component |
|---|---|
| 17.62 | TMPEOTA |
| 4.42 | Photomer ® 5018 |
| 22.02 | Ebecryl ® 1608 |
| 5.28 | Darocur ® 1173 and 10% benzophenone |
| 2.80(3%) | Ebecryl ® 350 |
| 1.87(2%) | Ebecryl ® 1360 |

The dispersion was coated onto DR base paper with a smooth (#0) Mayer Rod and cured dry in one pass at 300 ft/min (150 cm/sec) under two 300 watts/inch (about 120 watts/cm) mercury lamps.

Mix Viscosity: 440 cps

Resistivity: $0.6\times10^6$ Ω/□

Peel Force: 15–25 g/in (38–64 g/cm)

Example 16

This example illustrates the use of a non-acrylic ethylenically unsaturated free-radical polymerizable quaternary salt precursor in the coating mixture. For comparative purposes, DMDAC was used in an amount equimolar to the Ageflex® FA1Q80MC of Example 15. A coating mixture was prepared from the following components:

| Parts | Component |
|---|---|
| 36.37 | 60% aq.soln. of DMDAC |
| 20 | β-CEA |
| 20 | TMPEOTA |
| 22 | Ebecryl ® 1608 |
| 5.3 | Darocur ® 1173 |
| 1.0 | Ebecryl ® 350 |

The hazy dispersion was coated onto DR base paper with a #0 Mayer rod and onto polyethylene terephthalate film with a #36 Mayer rod and cured using two 300 watts/in (about 120 watts/in) mercury lamps and one pass at 200 ft/min (100 cm/sec) and two passes at 100 ft/min (50 cm/sec). The cured coatings were both glossy and dry-to-touch. The coating on the film were transparent though hazy. Both coatings released 610 tape well. The paper coating had a resistivity of $5\times10^5$ Ω/□. The film coating had a resistivity of $10\times10^6$ Ω/□.

Having described the invention, we now claim the following and their equivalents.

What is claimed is:

1. An imaging element comprising a support structure and an imaging layer structure wherein the support structure is removably adhered to the imaging layer structure and wherein the support structure comprises an electrically conductive polymeric release layer having tailored optical and surface release properties comprising, in polymerized form:

(A) 1 to 80 weight parts of a polymerizable, ethylenically unsaturated ammonium precursor;

(B) 0.1 to 10 weight parts of a polymerizable, ethylenically unsaturated, organo-silicone precursor;

(C) 5 to 95 weight parts of a multifunctional polymerizable precursor containing at least two polymerizable, ethylenically unsaturated functional groups;

(D) 0 to 60 weight parts of a polymerizable, ethylenically unsaturated acidic precursor containing at least one carboxylic acid group; and (E) 0 to 90 weight parts of a monofunctional precursor containing one polymerizable, ethylenically unsaturated functional group.

2. The element of claim 1 wherein said electrically conductive polymeric release layer has a thickness between about 1 micron to about 20 microns and an electrical resistance between about $1\times10^5$ Ω/□ and $1\times10^8$ Ω/□.

3. The element of claim 2 wherein said electrically conductive polymeric release layer has a surface energy of between 20 and 40 dynes/cm$^2$.

4. The element of claim 1 wherein said polymerizable, ethylenically unsaturated ammonium precursor contains a cation selected from the group consisting of (3-(methacryloylamino)propyl)trimethylammonium, (2-(methacryloyloxy)-ethyl)-trimethylammonium, (2-(acryloyloxy)-ethyl)trimethylammonium, (2-(methacryloyloxy)-ethyl)-methyldiethylammonium, 4-vinylbenzyltrimethylammonium, dimethyldiallylammonium, and mixtures thereof.

5. The element of claim 4 wherein the ammonium precursor is 2-(acryloyloxy)-ethyltrimethylammonium chloride.

6. The element of claim 1 wherein said polymerizable, ethylenically unsaturated, organo-silicone precursor is an acrylated-oxyalkylene-silicone precursor wherein the alkylene is ethylene, propylene or a combination thereof.

7. The element of claim 6 wherein the multifunctional polymerizable precursor is a multifunctional monomeric material, an oligomeric material, or a combination thereof.

8. The element of claim 1 wherein said element is an electrographic imaging element.

9. The element of claim 7 wherein said element is an electrographic element, wherein said support structure comprises, in order:

(1) a base, and (2) said electrically conductive polymeric release layer, and wherein said imaging layer structure comprises, in order:

(3) a protective layer, (4) a dielectric layer, and (5) an adhesive layer, and wherein said electrically conductive polymeric release layer is removably adhered to said protective layer.

10. The element of claim 9 wherein said electrically conductive polymeric release layer has a thickness between about 1 micron and about 20 microns and an electrical resistance between about $1\times10^5$ Ω/□ and $1\times10^8$ Ω/□.

11. The element of claim 10 wherein said electrically conductive polymeric release layer has a surface energy of between 20 and 40 dynes/cm$^2$.

12. The element of claim 11 wherein said dielectric layer and said adhesive layer are combined in a single dielectric/adhesive layer whose dielectric constant is between about 2 and 5 and whose adhesive properties are activated at a temperature above ambient temperature.

13. The element of claim 12 wherein said dielectric/adhesive layer comprises one or more materials selected from the group consisting of polyurethanes; polyamides; polyolefins; polycarbonates; polystyrenes; polymers or copolymers of acrylic acid, methacrylic acid, acrylic esters, methacrylic esters, acrylic amides, methacrylic amides, styrenes, acrylonitriles, vinyl esters, alkyd substituted vinyl esters, vinyl alcohol, vinyl acetals, vinyl chloride, vinyl fluoride, vinylidene chloride, and 1,4-dienes; ethylene/vinyl alcohol copolymers; copolymers of styrene with acrylic and methacrylic monomers; modified cellulosic resins; and block copolymer thermoplastic rubbers.

14. The element of claim 12 wherein said protective layer consist essentially of a fluoropolymer and an acrylic polymer.

15. The element of claim 14 wherein said electrically conductive polymeric release layer has a thickness between about 1 micron and about 20 microns, an electrical resistance between about $1\times10^5$ Ω/□ and $1\times10^8$ Ω/□, and a surface energy of between 20 and 40 dynes/cm$^2$.

16. The element of claim 15 wherein said polymerizable, ethylenically unsaturated, organo-silicone precursor is an acrylated-oxyalkylene-silicone precursor wherein the alkylene is ethylene, propylene or a combination thereof.

17. The element of claim 9 wherein said support structure additionally comprises a second electrically conductive polymeric release layer and wherein said support structure comprises, in order: said second electrically conductive polymeric release layer, said base, and said electrically conductive polymeric release layer.

18. The element of claim 1 wherein a liquid precursor mixture comprising precursors (A) through (C) and precursors (D) and (E), if present, is coated to form a coated liquid precursor mixture, and following coating, said coated liquid precursor mixture is cured to form said polymeric conductive/release layer.

19. The element of claim 18 wherein said liquid precursor mixture is dissolved in a coupling solvent.

20. The element of claim 19 wherein said coupling solvent is selected from the group consisting of water, water miscible organic solvents, and mixtures thereof.

21. The element of claim 20 wherein said water miscible organic solvent is selected from the group consisting of diethylene glycol ethyl ether, diethylene glycol butyl ether, tetrahydrofurfurylalcohol, γ-butyrolactone, and 1-methoxy-2-propanol.

22. The element of claim 18 wherein said precursor mixture is a stable, homogeneous, liquid dispersion.

23. The element of claim 18 wherein a liquid precursor mixture is cured to form said polymeric conductive/release layer by irradiation with an electron beam.

24. The element of claim 18 wherein a liquid precursor mixture is cured to form said polymeric conductive/release layer by irradiation with ultraviolet light.

25. The element of claim 7 wherein said electrically conductive release layer comprises 60 to 80 weight parts of said ethylenically unsaturated ammonium precursor and 0.2 to 2 weight parts of said polymerizable, ethylenically unsaturated, organo-silicone precursor.

26. The element of claim 25 wherein said ethylenically unsaturated ammonium precursor is:

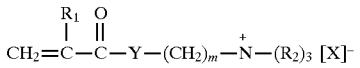

in which $R_1$ is H, methyl, or ethyl; Y is —O— or —($NR_3$)—, wherein $R_3$ is H or a $C_1$–$C_4$ alkyl; m is an integer from 1 to 4, each $R_2$ individually is a $C_1$–$C_4$ alkyl group; and $[X]^-$ is an anion.

27. The element of claim 25 wherein said electrically conductive polymeric release layer additionally comprises 1 to 20 weight parts of amorphous silica, based on the total weight of the polymerizable materials.

* * * * *